US005221056A

United States Patent [19]

Walliser et al.

[11] Patent Number: 5,221,056

[45] Date of Patent: Jun. 22, 1993

[54] PNEUMATICALLY CONTROLLED SPOOLING APPARATUS

[75] Inventors: Carl J. Walliser, Mundelein; Thomas L. Harrison, Villa Park, both of Ill.

[73] Assignee: Print-O-Tape, Inc., Mundelein, Ill.

[21] Appl. No.: 475,119

[22] Filed: Feb. 5, 1990

[51] Int. Cl.[5] ..... B65H 19/26

[52] U.S. Cl. ..... 242/56 A; 242/64

[58] Field of Search ..... 242/56 A, 56 R, 56.6, 242/64

[56] References Cited

U.S. PATENT DOCUMENTS

| | | | |
|---|---|---|---|
| 1,958,068 | 5/1934 | Raiche | 242/56 A |
| 2,970,786 | 2/1961 | Justus et al. | 242/64 |
| 3,350,027 | 10/1967 | Egan | 242/56 A |
| 3,472,462 | 10/1969 | Young | 242/56 A |
| 3,733,035 | 5/1973 | Schott, Jr. | 242/56 A |
| 3,752,412 | 8/1973 | Byrt | 242/56 A |
| 3,796,388 | 3/1974 | Davis | 242/56 A |
| 3,871,595 | 3/1975 | Smolderen | 242/56 A |
| 3,930,620 | 1/1976 | Taitel | 242/56 A |
| 3,985,313 | 10/1976 | Klein et al. | 242/56 A |
| 4,038,127 | 7/1977 | Bullock, Jr. et al. | 242/56 A |
| 4,356,983 | 11/1982 | Weiss | 242/75.4 |

*Primary Examiner*—John M. Jillions
*Attorney, Agent, or Firm*—Eugene F. Friedman

[57] ABSTRACT

A spooling apparatus attachable to a printing press and operating under pneumatic control and power. An elongated web passes through a linear slitter, over a unidirectional roller, and onto a take-up spool. The spool rotates on power received through a belt drive and a variable speed gear box from the press itself. Upon the receipt of a signal from the press, a pneumatically controlled and powered knife cuts the web and urges it onto another spool. A spring dampener keeps the knife from bouncing and produces a clean cut. When the knife returns to its original position, the pneumatics applies a brake to the full spool to stop its rotating and allow the operator to remove the spooled web. The pneumatics then lifts a cam follower from a stop in a cam and engages a clutch to rotate the frame which holds the rollers for the spooling. This brings the filling spool to the location previously occupied by the full spool. There it continues to rotate and take up the web. Magnetic clutches on the rollers allow for the application of a constant force to them notwithstanding the constantly increasing circumference on the spool receiving the incoming web.

43 Claims, 7 Drawing Sheets

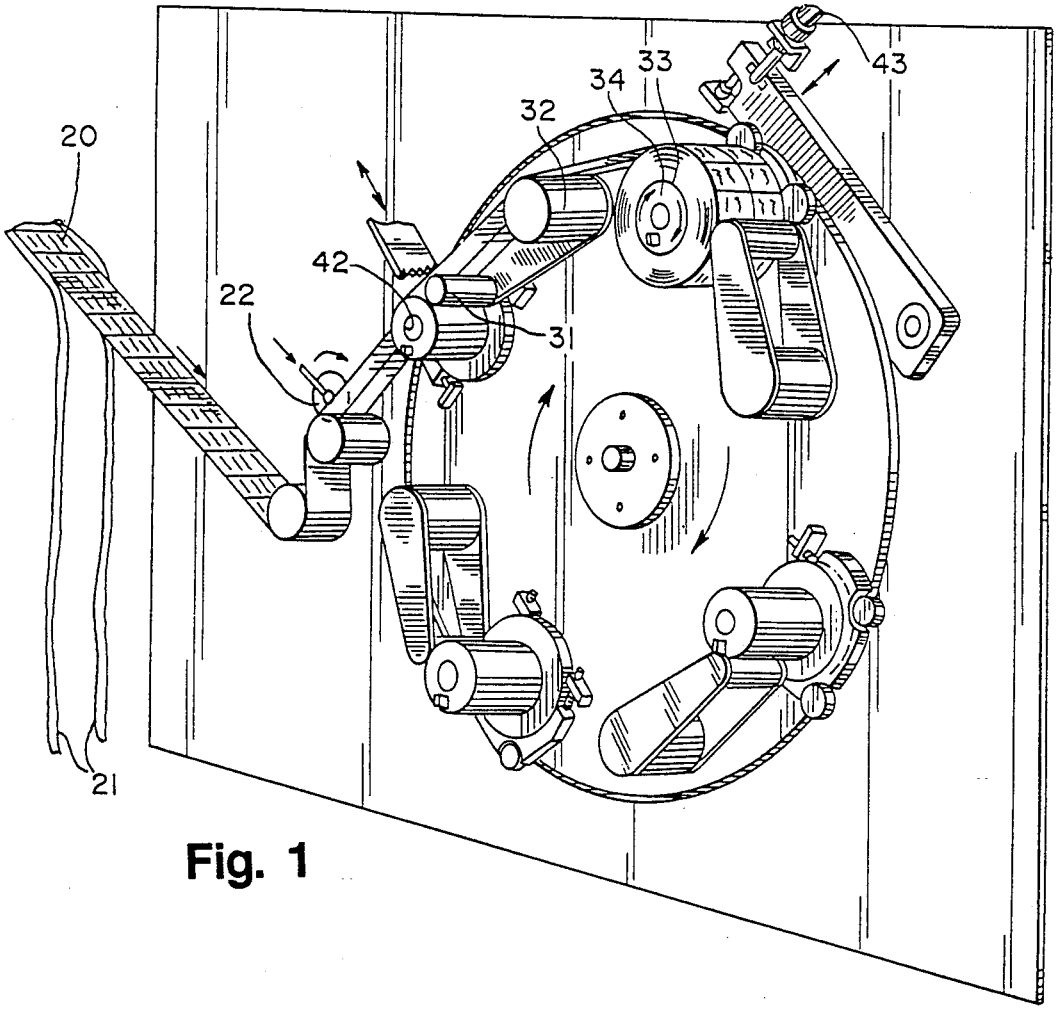
Fig. 1
Fig. 2
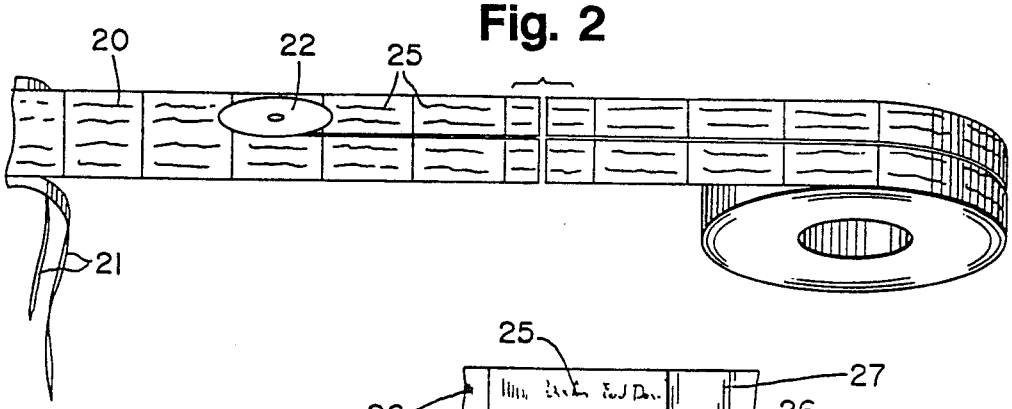
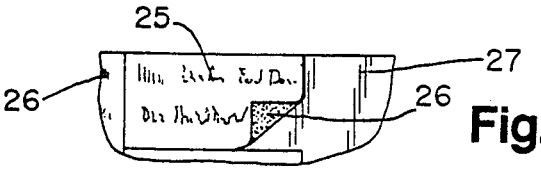
Fig. 3

Fig. 11
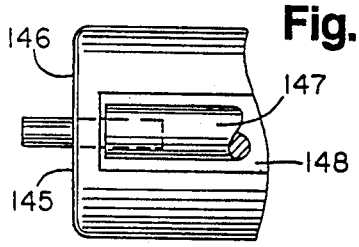
Fig. 10
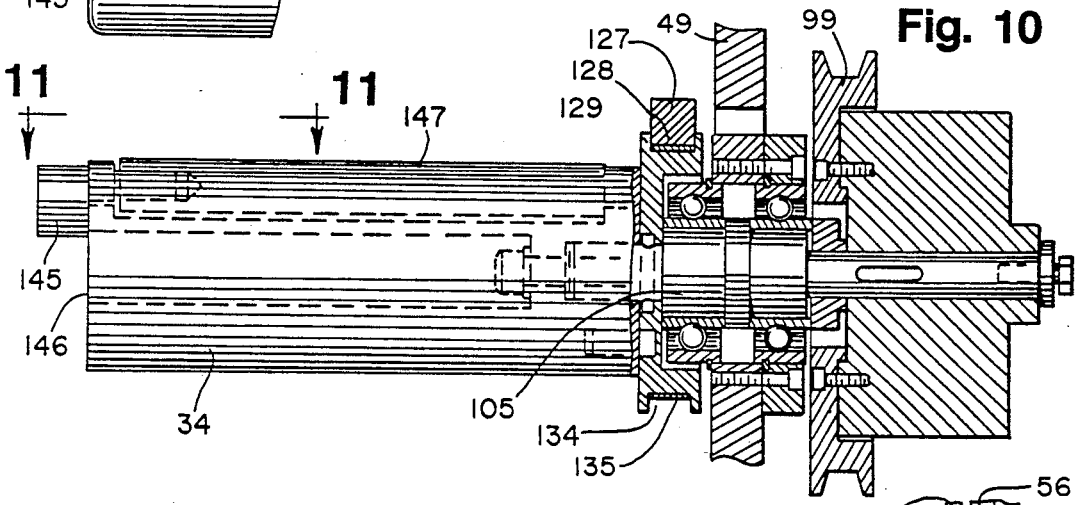
Fig. 9
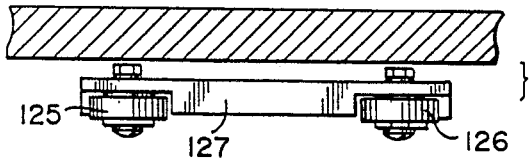
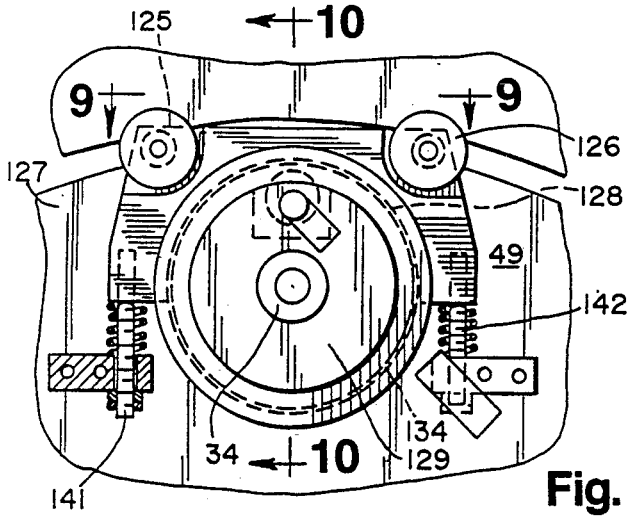
Fig. 8
Fig. 7
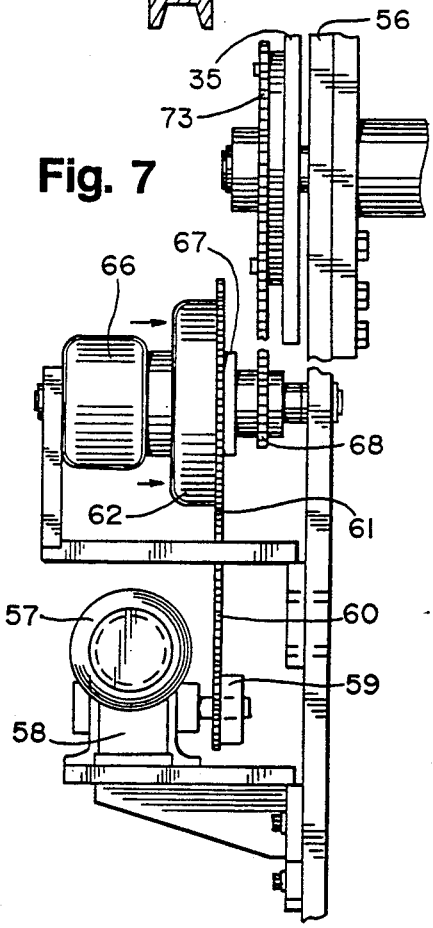

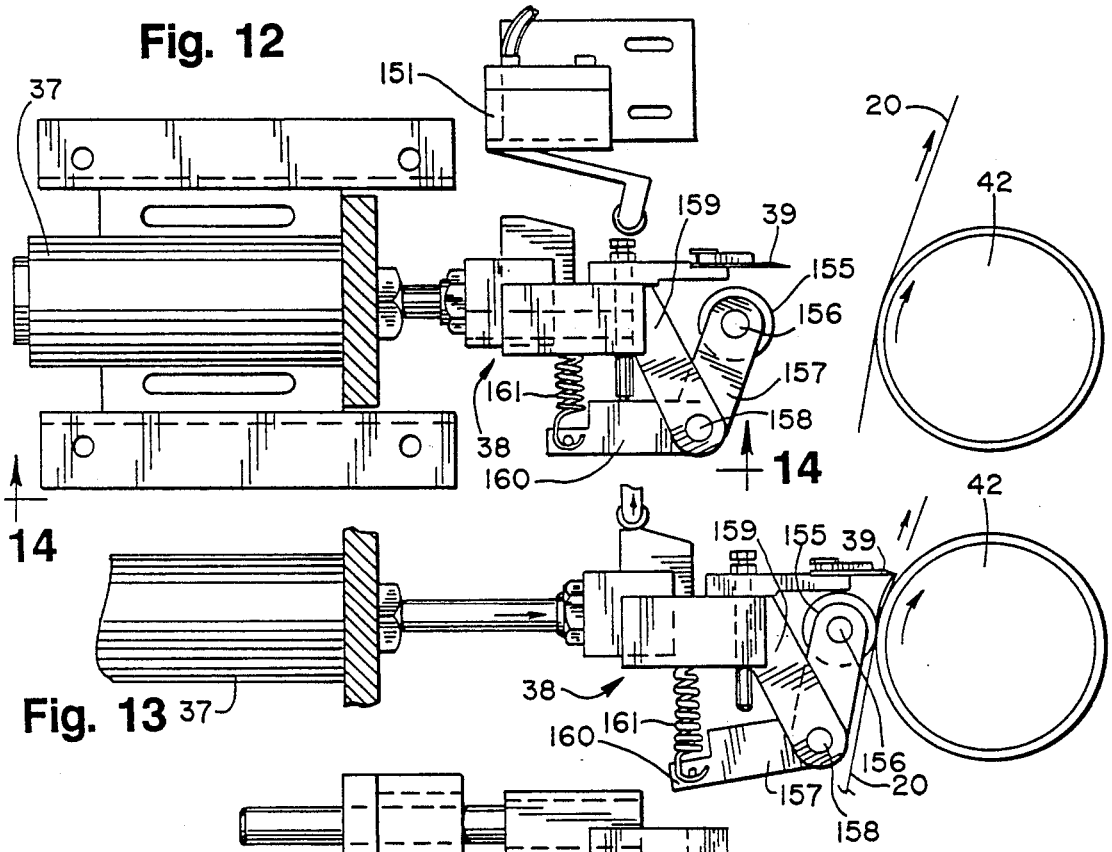
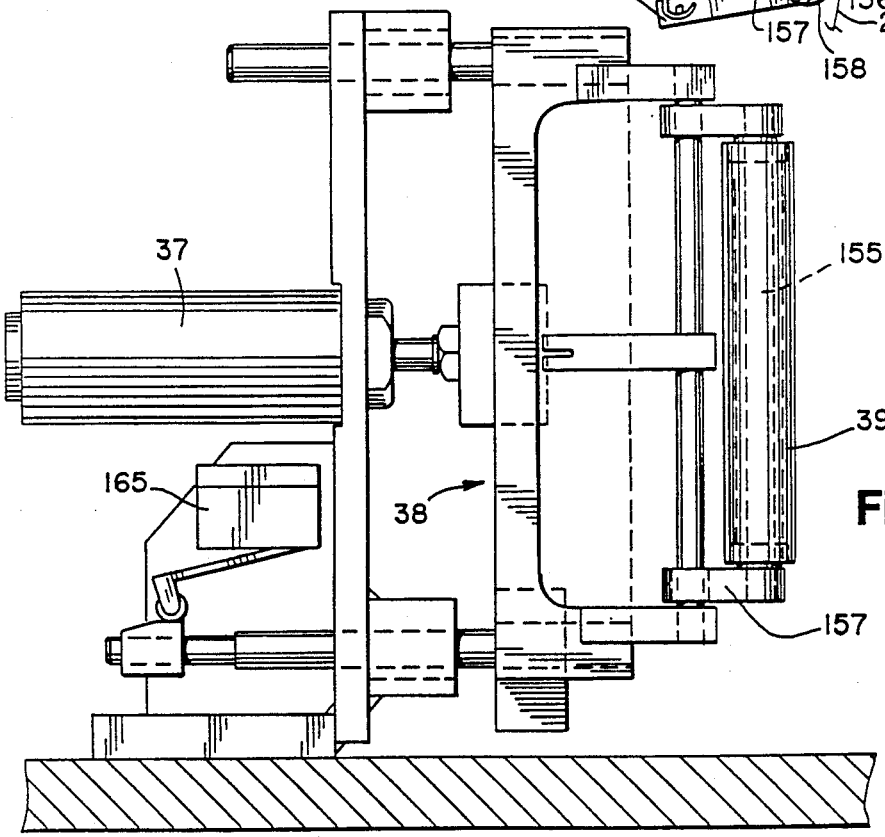
Fig. 14

PNEUMATICALLY CONTROLLED SPOOLING APPARATUS

BACKGROUND

Printing presses produce labels in long, uninterrupted strips. Making use of the labels typically involves spooling the labels in long spirals on cylindrical cores.

Present equipment for placing the strips of labels incorporates extensive electronic or, as in U.S. Pat. No. 2,585,226 to P. J. Christman, mechanical components to achieve its proper operation. A strip, after the appropriate number of labels has attached to a core, must be cut. The roller with the full core must then move out of the way. A new core on a further roller must then move into the location where it can receive labels. An operator must then attach the strip onto the new core so that the process may start anew.

Difficulties encountered in accomplishing these goals result from the facts that labels on different strips have different lengths. Further, the speed of the printing press in producing the labels may also vary. Additionally, as the number of labels on a core increases, so does the circumference of the core with its labels; as a result, the force rotating the roller increases which may also unacceptably tighten the strip on the core or even break the strip itself.

The extensive and expensive electronics and mechanics of the equipment currently finding use attempt to compensate for many of these variables. Even still, it nonetheless requires substantial operator attention and skill to achieve its desired results, which may prove difficult even yet. As a result, the search for improved spooling equipment continues.

SUMMARY

Typically spooling equipment includes a frame. A plate movably couples to the frame. A plurality of take-up rollers mounts on the plate. A motive device couples to the frame and the plate. It has the purpose of moving the plate in a manner to sequentially bring each of the rollers, in turn, to a particular location. Lastly, a revolving device couples to the one of said rollers in said particular location and rotates that roller.

An improved spooling apparatus results from the incorporation of a pneumatic control device coupled to the motive device. Operating under pneumatic power and control, it has the purpose of, with one of the rollers in the particular location, causing the motive device to move the plate in a direction to bring another of the rollers to the particular location. Once the subsequent roller reaches the designated location, the pneumatic controller stops the motive device from moving the plate further.

The pneumatics eliminates the need for expensive electronics while still establishing the control required of the apparatus. Thus, it results in less expensive equipment but with sophisticated and reliable controls.

Alternately, the spooler may include a braking device coupled to the roller at the particular location. After the revolving device has rotated this roller and before the roller returns once again to the particular rotation, the brake stops the rotation of the this one roller. This permits the operator to facilely remove the full core from the roller.

As a further and separate improvement, the equipment may include a clutch device coupled between the revolving device and the roller at the particular location. The clutch applies a substantially constant force from the revolving device to the roller regardless of the amount of the web spooled on the roller. Without the clutch, the force on the roller would increase as the web spools on the roller, in effect increasing its outer circumference. This could result in an unacceptable tightening, or cinching, of the web on the core or even the breaking of the web itself. The clutching device, for example, a magnetic clutch, avoids these deleterious results.

Generally, the spooler includes a cutting device coupled to the frame. The cutter moves between first and second positions. As it moves from the first to the second position, it severs an elongated web being spooled onto the roller in the particular location. As a further feature, the spooler may include a dampening device coupled to the cutter. It reduces the speed of the cutter as it moves from the first to the second position but prior to the time the cutter actually reaches the second position. This dampener helps keep the cutter from bouncing as it cuts the web. The resulting precise movement of the cutter results in a cleaner cut of the web with less waste of material.

Alternately or additionally, the spooler with a cutter may also include a restraining device. Coupled to the frame, the restraining device resists the backward movement of the portion of the web just past where the cutter severs it. This action keeps the web taught in the region of the cutter and also helps assure a clean cut.

BRIEF DESCRIPTION OF THE FIGURES

FIG. 1 provides a perspective view of a spooler winding a web on a core.

FIG. 2 shows a web undergoing trimming, slitting and spooling.

FIG. 3 displays a web composed of labels adhered to a backing strip.

FIG. 7 provides a partial cross-sectional view along the line 7—7 of the components of FIG. 6.

FIG. 8 gives a front elevational view of a roller for holding a core for labels along with the braking mechanism for stopping the rotation of the roller.

FIG. 9 shows a cross-sectional view along the line 9—9 of the braking mechanism shown in FIG. 8.

FIG. 10 gives a cross-sectional view along the line 10—10 of the roller mechanism of FIG. 9.

FIG. 11 provides a top plan view of the gripping mechanism of FIG. 10.

FIG. 12 gives a front elevational view of the cutter used to sever the web.

FIG. 13 provides a similar view of the cutter of FIG. 12 but in its cutting configuration.

FIG. 14 gives a bottom plan view along the line 14—14 of the cutter of FIG. 12.

DETAILED DESCRIPTION

Figure 4:
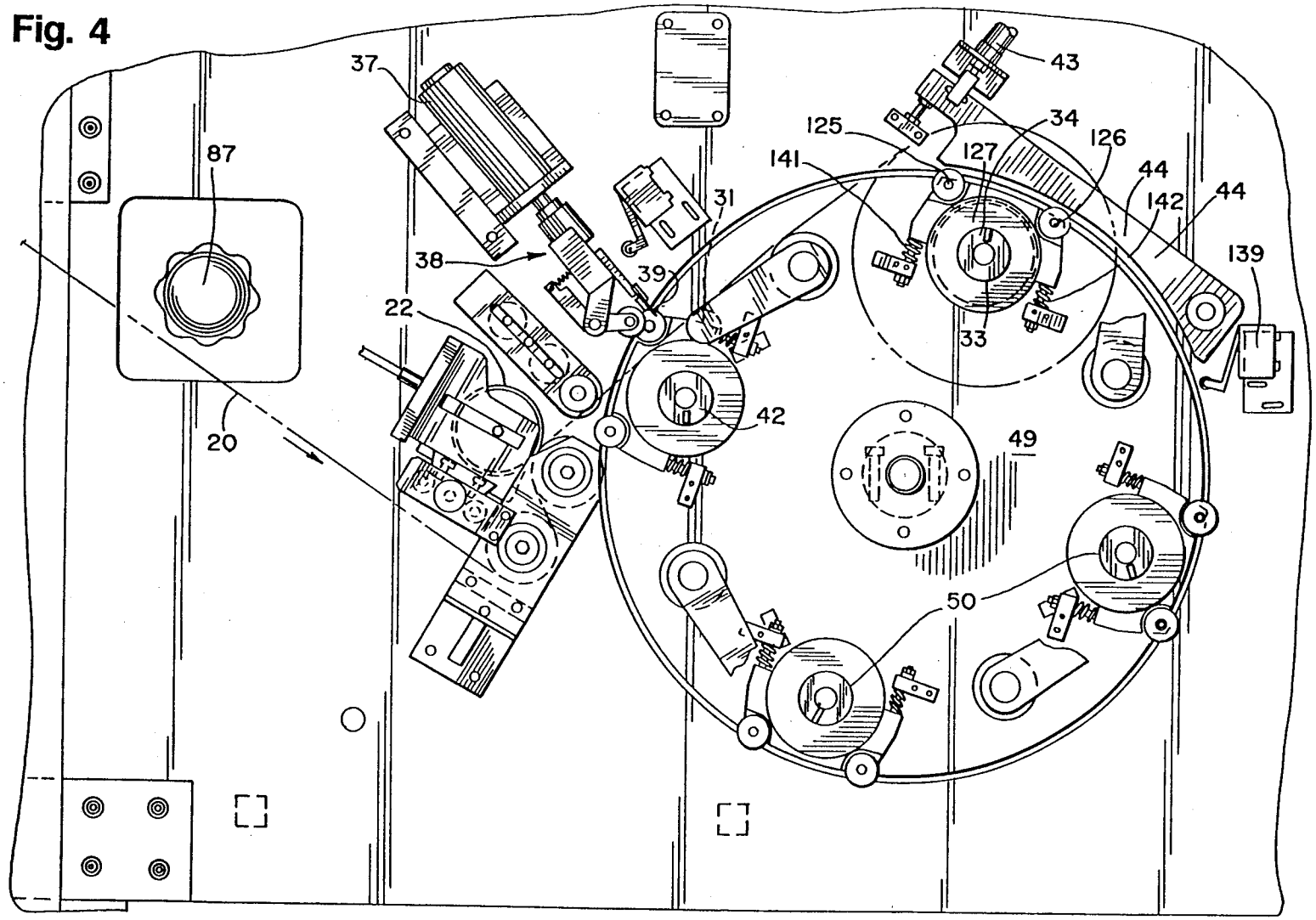
FIG. 4 gives a front elevational view of an apparatus spooling a strip onto cores.

FIG. 1 shows the strip of labels 20 emanating from a printing press (not shown). It has its excess margins 21 trimmed and undergoes slitting at the knife 22. The strip 20 is composed of the labels 25 with the adhesive backing 26 and the support layer 27 as seen in FIGS. 2 and 3.

As seen in FIGS. 1 and 4, the strip (seen in phantom in the latter) after leaving the slitter 22, passes over the unidirectional idler 31 (seen in section in FIG. 1) and then the bidirectional roller 32. From there, it spools onto the cardboard core 33 held onto the roller 34. The core 33 may include a light adhesive as shown in U.S. Pat. No. 4,950,518 of Carl Walliser, entitled CORE FOR SPOOLING STRIPS OF LABELS. The adhesive permits the facile and automatic attachment and detachment of the label strip 20 without deleteriously affecting the strip itself. After the passage of a predetermined number of labels 25, the pneumatic cylinder 37 extends the knife assembly 38 until the blade 39 actually severs the strip 20. As the blade 39 extends, it pushes the strip 20 against the one-way idler roller 31. However, the roller 31 will not rotate in a direction that would allow the strip 20 to move backward. Thus, the idler 31 provides a better angle for the blade 39 to cut the strip 20. Moreover, it refuses to allow the strip to move backward under pressure from the blade 39; as a consequence, the strip 20 stays taut so that the blade 38 may effectuate its cut. The force of the blade then places the raw end of the strip 20 against the next roller 42, where it starts to spool once again.

As discussed below with regards to FIG. 15, the retraction of the knife assembly 38 into the cylinder 37 trips a pneumatic switch not seen except in FIG. 15. This in turn causes the cylinder 43 to extend to apply the mandrel brake 44 which stops the rotation of the roller 34, analyzed in connection with FIGS. 8 to 10 below. The operator may then remove the spooled strip and place a new core on the roller 34 for the next time it receives labels.

The retraction of the knife 38 also induces the rotation of the plate 49 which holds the rollers 34, 42, and 50. As the first step, the cylinder 52 in FIG. 5 extends to lift the plate 51 to the position seen in phantom. This movement of the plate 51 initially lifts the cam follower 54 out of the indentation 55 in the cam plate 56. This allows, but does not cause, the cam plate 56 to rotate. The cam plate 56 connects to the roller plate 49 on the front of the apparatus, which may now rotate.

The power to rotate the cam plate 56 derives ultimately from the motor 57 and passes through the 40:1 gear reducer 58. It then travels to the gear wheel 59 which moves the sprocket chain 60, as seen in FIG. 7. The chain 60 in turn drives the larger sprocket wheel 61 attached to the clutch 62. The relative sizes of the sprocket wheels 59 and 61 results in a further 2:1 speed reduction of the power from the motor 57.

When the cylinder 52 lifts the plate 51 and removes the cam follower roller 54 from the stop 55 in the cam plate 56, it also trips the pneumatic microswitch 65. This in turns provides pneumatic pressure to the clutch 66 which forces the clutch plate 67 against idler plate 68 to turn the second chain 73. This causes the sprocket wheel 74 to turn. Since the sprocket wheel 74 connects to the cam plate 56 and thence to the roller plate 49, these rotate as well. This brings the second roller 42 into the position occupied originally by the first roller 34 as shown FIG. 1 above.

As the cylinder 52 lifts the plate 51, the latter also trips the switch 78. With a light built-in delay, this resets the cylinder 52 to let the cam roller 54 follow the surface of the cam plate 56. When it reaches a stop, it enters the indentation. This stops the cam plate 56 and thus the roller plate 49 at a position where the second roller 42 occupies the position just recently vacated by the first roller 34. There the second roller 42 spools the strip 20 until the process repeats itself.

Figure 5:
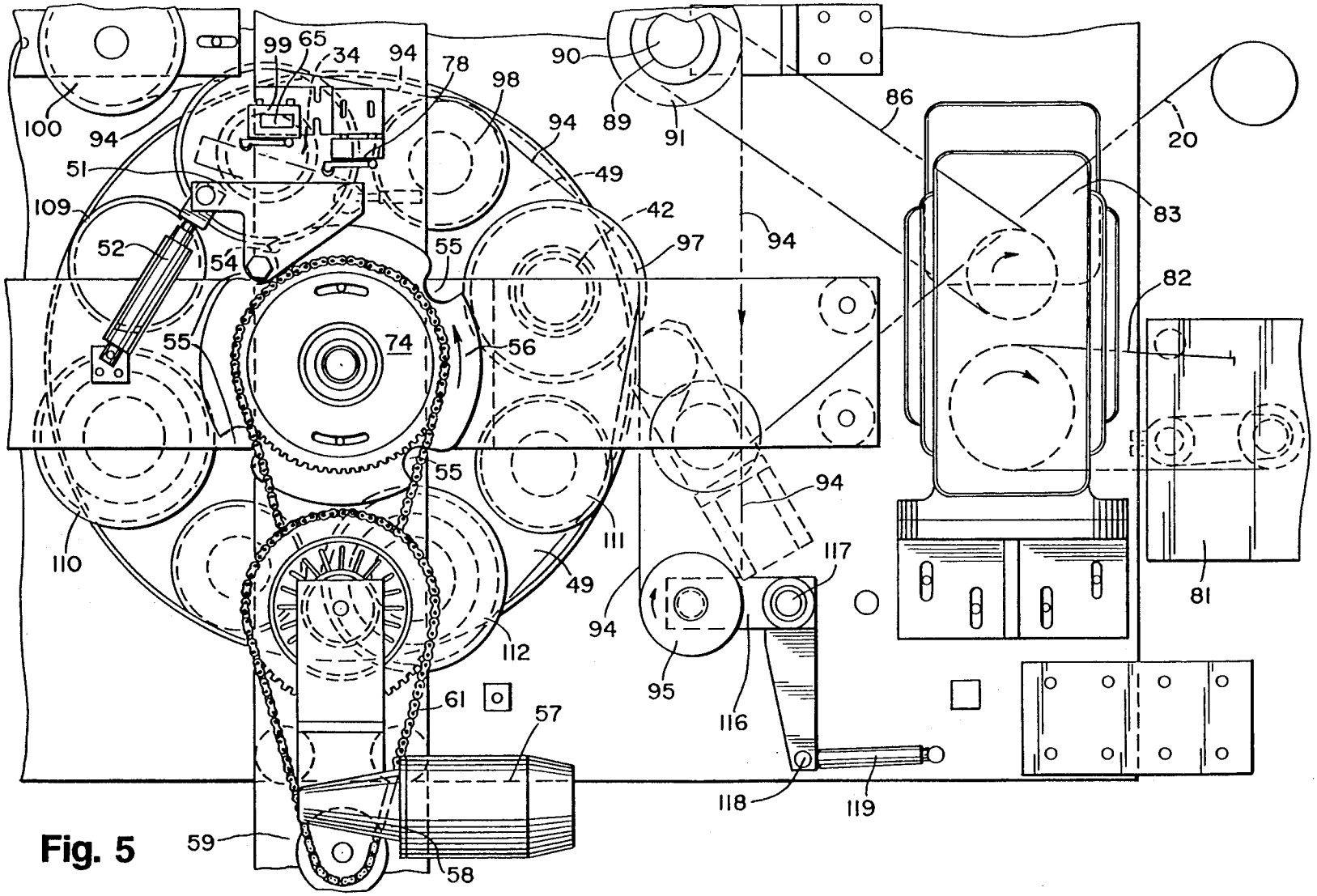
FIG. 5 provides a rear elevational view of the spooler of FIG. 4.
Figure 6:
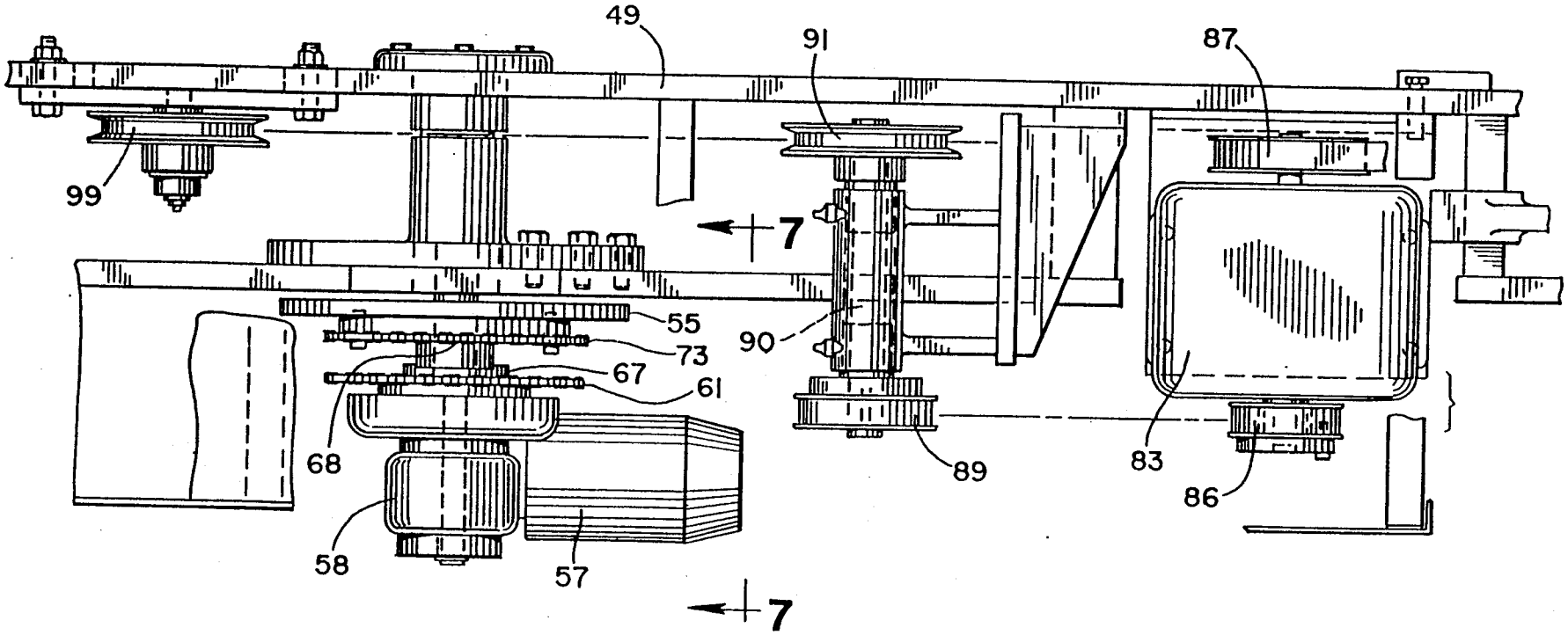
FIG. 6, in a top plan view, shows those components of FIG. 5 which rotates the rollers on which sit the cores for the strip and which move the rollers after they receive a full allotment of labels.

FIGS. 5 and 6 show how the printing press rotates the spooling rollers 34 and 42. Specifically, the press 81 drives the belt 82 which couples through the variable ratio gear box 83 to drive the interconnecting belt 86.

The operator can exchange the rollers 34, 42, and 50 with others having different sizes of shafts. This will accommodate cores with differing diameters. The ratio of the gear box 83 submits to adjustment by the operator (via the knob 87 on the front of the equipment in FIG. 4) in order to accommodate rollers of different sizes and other variables.

Returning to FIG. 5, the intermediate belt 86 drives the wheel 89 connected by the axle 90 to the wheel 91. The wheel 91, in turn, drives the primary belt 94, which, after passing over the wheel 91, drops down to and around the idler wheel 95. It then travel back upward and contacts and drives the wheels 97, 98, and 99. It then passes around the idler wheel 100 and back to the wheel 91 to repeat its path.

As seen in FIGS. 7 and 10, the wheel 99 couples to the roller 34. Similarly, the wheel 97 couples to the roller 42. When the belt 94 drives the former of each pair, the latter (i.e., the rollers) also turn to spool the strip 20.

As seen in FIG. 10, the wheel 99 couples to the roller 34 through the magnetic clutch 105. As the web 20 spools onto the roller 34, it effectively increases its outer circumference. This would result in an increase in the backward force exerted by the strip 20 on the roller 34 which would cause the strip to become unacceptably tight on the roller or even break. The clutch 105 maintains a generally constant force on the roller without regards to the amount of strip on the roller.

As seen in FIG. 5, the belt 94 does not actually wrap around any of the wheels 97, 98, or 99, all of which mount on the rotating plate 49. Rather the belt 94 merely makes contact with just one side of these wheels. This permits the plate 49 to rotate and the wheels to move without breaking the belt 94. Thus when the plate turns to bring the roller 42 into the position occupied by the roller 34 in FIG. 1, the wheels 98 and 99 will move in the counterclockwise direction in FIG. 5 to the positions of the wheels 109 and 110. At the same time, the wheels 111 and 112 will move into the positions of the wheels 98 and 97, respectively. There they will make contact with the belt 94 and start to turn. The wheel 112 couples to the roller 50 which now becomes operational.

The wheel 95 for the belt 94 is journalled to the L bracket 116 which can pivot about its attachment 117 to the frame. At its other end 118, the bracket 116 attaches to the springs 119 which pulls the bracket end 118 to the right in the figure. This pressure keeps the belt 94 taut as the plate 49 with the wheels revolves. Yet, it provides some play when the exact placement of the wheels requires it.

As indicated previously, the cylinder 43 forces the plate 44 downward, in FIG. 1, to stop the roller 34 from rotating. The plate 44, in turn, pushes against the small wheels 125 and 126 mounted on the plate 127 having the half circular concave cutout 128 facing the base 129 of the roller 34. In fact, the movable plate 127 fits into the groove 134 of the roller's base 129 as seen best in FIG. 10. Further, the groove 134 includes the lining 135 of material used in brake surfaces.

When the cylinder 43 forces the plate 44 downward, the latter pushes against the wheels 125 and 126 and thus the plate 127 which contacts, under pressure, the frictional lining 135 in the groove 134 in the base 128 of the roller 34. This pressure against the base of the roller 34 stops its rotation. As the plate 49 moves in the clockwise direction in FIG. 1, the rollers 125 and 126 stay in contact with the plate 44 which keeps the pressure on the base 129 of the roller 34 to make sure it stops rotating.

Eventually, as the plate 49 undergoes clockwise rotation in FIG. 1, the lead roller 126 trips the pneumatic microswitch 139 to retract the cylinder 43, lift the plate 44, and allow the next roller 42 to rotate as it moves into the position shown for the roller 34.

Further, when the plate 44 lifts, the springs 141 and 142 force the plate 127 back to its original position. There, it cannot contact the roller 34 which may thus start to rotate when it reaches the position shown in FIG. 1 for the roller 42.

In FIGS. 10 and 11, the roller 34 includes the knob 145 at its end 146. Turning the knob 145 extends the gripper surface 147 outside of the opening 148 in the roller 34. The gripper extending outside the roller effectively increases it outer perimeter. After placing a core on the roller 34, the operator turns the knob 145 to extend the gripper 147. This serves to securely attach the core to the roller. After the core has received its quota of labels, the operator turns back the knob 145 to retract the gripper 147 back into the roller 34 and release the full core.

The knife assembly 38, mentioned briefly above, appears in FIGS. 12 to 14. When the cylinder extends the assembly 38 to start a severing operation as in FIG. 12, it causes the assembly 38 to trip the pneumatic microswitch 151. This initiates the process for returning the knife assembly 38 to its original position after making its cut on the strip 20.

As the assembly 38 continues to move to the right in the figures, the blade 39 will approach the strip 20. Before this happens, however, the cylindrical bumper 155 will contact the roller 42. The bumper 155 has a freedom of rotation so that it may circulate about its longitudinal axis while in contact with the rotating roller 42.

The bumper 155 has the rotating connection 156 to the angle bracket 157 which similarly has the pivoting connection 158 to the tab 159. The other end 160 of the bracket 157 attaches to the spring 161 which resists its downward motion. As the bumper contacts the roller 42, it attempts to force the end 160 of the bracket downward. The spring 161 creates a force against the continued motion of the knife blade 39 to the right. The blade 39 travels sufficiently far to effect the desired cut. However, the spring 161, acting through the bumper 155, slows down the blade's motion. This keeps the blade 39 from bouncing at the end of its path and allows it to make a single, clean cut.

When the cylinder 37 pulls the assembly 38 back to the right as seen in FIG. 14 after making a cut, the latter trips the microswitch 165. As discussed above, this starts the process for rotating the plate 49 in FIG. 1 to bring the roller 42 into the location occupied by the roller 34.

Figure 15:
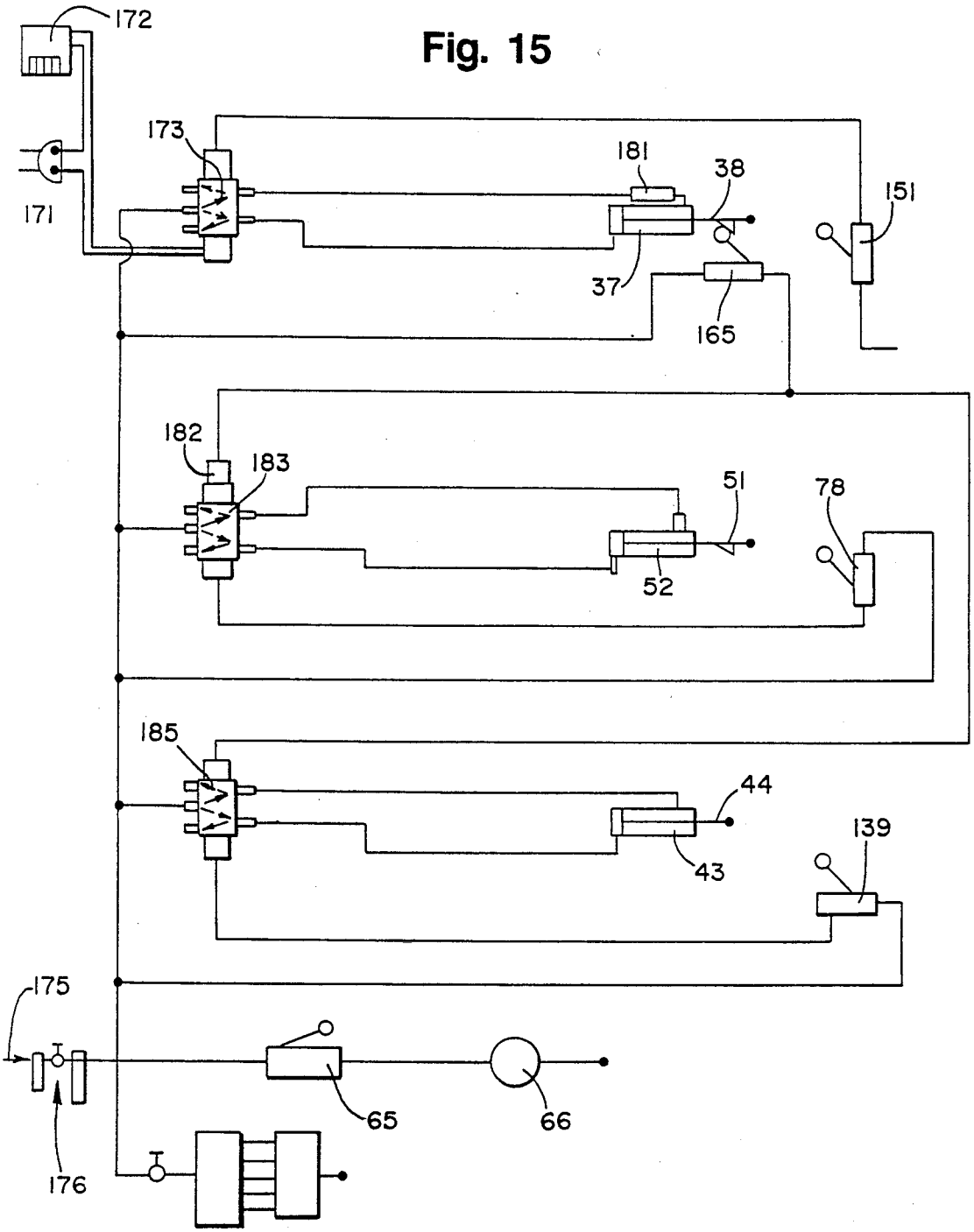
FIG. 15 shows the pneumatic circuit for the spooler of FIGS. 1 to 14.

FIG. 15 shows a pneumatic circuit that can control and power the operation of the equipment of the previous figures. Using normal house current from the plug 171, the counter 172 on the main press keeps count of the labels produced. When it has reached the present count, it sends a pulse to the 4-way directional valve 173 which includes a solenoid portion responsive to this pulse.

The remainder of the circuit of FIG. 15 contains only pneumatic components. The air pressure for the circuit, amounting to about 80 to 100 p.s.i., appears along the inlet 175 and phases through the filter, regulator, and lubricator 176. As indicated in the drawing, it then splits and travels to the various circuit components.

The electrical pulse from the counter 172 shifts the solenoid operated valve 173 which, as a consequence, applies pressure to the cylinder 37 to extend the cutting knife assembly 38. This severs the strip to complete a roll.

As the knife assembly extends, it trips the pneumatic microswitch 151 which resets the valve 173. The valve 173 then applies pressure to the speed control section 181 of the cylinder. This allows the cylinder 37 to retract the knife assembly 38 but at a reduced speed.

The knife assembly 38 returns at a controlled speed into the cylinder 37 because, as it does, it trips the switch 165 which sets the remainder of the circuit, and equipment, into operation. Initially, the switch 165 sends pressure to the impulse valve 182 which converts it to a pulse for the 4-way directional valve 183. This in turn briefly extends the turret index stop cylinder 52 to, as seen in FIG. 5, lift the cam follower roller 54 out of the stop indentations 55 on the cam 56. This allows the plate 49 to resolve and bring another roller into operating position to spool labels.

As the cylinder 52 extends, it also trips the switch 65. This causes the clutch 66 to engage and actually rotate the plate 49.

The extension of the cylinder 52 also trips the switch 78. This resets the valve 182 to let the cam roller 54 follow the cam 56 until it falls into a stop 55 to stop the plate 49. It also allows the switch 65 to reset and disengage the clutch 66.

When the knife assembly 38 retracts and trips the switch 165, the latter also applies pressure to the 4-way directional valve 185. This valve in turns extends the mandrel brake cylinder 43 which applies the mandrel brake plate 44 to stop the rotation of the roller after it has spooled the requisite number of labels. Eventually as the plate 49 rotates, the roller 126, in FIG. 4, trips the switch 139. This resets the valve 185 to allow the cylinder 43 to retract and remove the brake plate 44. Suitable components for the circuit shown in FIG. 15 include the Bimba 24-1.5-DP for the knife cylinder 37; the Bimba 04-.5-D for the brake cylinder 43; the Bimba 09-1.5-DP for the turret cylinder 52; the Mead MV90C4 for all of the switches 65, 78, 139, 151, and 165; the Horton Model LW for the clutch 66; the Allenaire VSE-SA for the solenoid operated 4-way valve 173; the Mead 414B for the impulse valve 182; and the Mead N2DP for the 4-way valves 183 and 185.

Accordingly, what is claimed:

1. In a device for spooling an elongated web of material including:

(A) a frame;

(B) a plate movably coupled to said frame;

(C) a plurality of take-up rollers mounted on said plate;

(D) motive means, coupled to said plate and said frame, for moving said plate in a manner to sequentially bring each of said rollers in turn to a particular location repeatedly in a cyclical fashion; and (E) revolving means, coupled to the one of said rollers in said particular location, for rotating said one roller, the improvement wherein said motive means operates substantially continuously and comprising (a) first clutch means, coupled to said plate and said motive means and having first and second configurations, for, in the first of said configurations, engaging said motive means to said plate so that said motive means moves said plate in said manner and, in the second of said configurations, disengaging said motive means from said plate; (b) control means, coupled to said first clutch means, for (1) with one of said rollers in said particular location, causing said first clutch means to assume said first configuration so that said motive means will move said plate to bring another of said rollers to said particular location and (2) causing said first clutch means to assume said second configuration to stop said motive means from moving said plate when said another of said rollers reaches said particular location; (c) coupling means, coupled to said frame, for attaching said device to a press; (d) take-off means, coupled to said revolving means, for providing said revolving means with sufficient power from said press to rotate said one roller, said take-off means including means for changing the speed at which said revolving means rotates said one roller; and (e) second clutch means, coupled between said revolving means and said one roller, for applying to said one roller a substantially constant force from said revolving means regardless of the amount of said web spooled on said one roller.

2. The improvement of claim 1 wherein said control means operates under pneumatic power and control.

3. The improvement of claim 1 wherein said control means operates under pneumatic power and control.

4. The improvement of claim 1 wherein said particular location is a first location and said motive means moves said frame in a manner to sequentially bring each of said rollers in turn to a second location prior to bringing said rollers to said first location, and further including affixing means, coupled to said frame, for attaching said web to a core on a roller in said second location.

5. The improvement of claim 1 wherein said control means includes a cam, coupled to said plate, with stops, a cam follower, coupled to said frame and capable of entering said stops, and a pneumatic cylinder with a piston coupled to said cam follower, said follower entering said stops when said plate is in a position where a roller is in said particular location.

6. the improvement of claim 5 wherein said control means operates under pneumatic power and control.

7. The improvement of claim 1 further including cutting means, coupled to said frame, for severing said web and pneumatic knife control means, coupled to said cutting means, for powering and controlling the action of said cutting means.

8. The improvement of claim 7 further including braking means, coupled to said one of said rollers for, after said revolving means has rotated said one roller and before said one roller has returned to said particular location, stopping the rotation of said one roller.

9. The improvement of claim 8 further including pneumatic brake control means, coupled to said brake means, for powering and controlling the action of said brake means.

10. The improvement of claim 9 further including restraining means, coupled to said frame, for, when said cutting means severs said web, resisting the movement of the portion of said web immediately past where said cutting means severs said web in a direction opposite to the direction said web moves when spooling onto said take-up roller in said particular location.

11. The improvement of claim 10 wherein said control means operates under pneumatic power and control.

12. The improvement of claim 10 wherein said second clutch means includes a magnetic clutch.

13. The improvement of claim 10 further including dampening means, coupled to said cutting means, for reducing the speed of said cutting means as it moves from said first to said second position and prior to the time said cutting means reaches said second position.

14. The improvement of claim 13 wherein said control means operates under pneumatic power and control.

15. The improvement of claim 13 wherein said dampening means includes a spring connected to said cutting means, said cutting means, as it moves from said first to said second position, increasing the force exerted by said spring in the direction opposite to that in which said cutting means travels when moving from said first to said second position.

16. The improvement of claim 13 wherein said braking means includes a frictional surface facing said one of said rollers and said brake control means urges said surface against said one roller.

17. The improvement of claim 13 wherein said restraining means includes a roller in contact with said portion of said web, said web moving freely in the direction said web moves when spooling onto said particular roller but having substantial resistance to moving in the opposite direction.

18. The improvement of claim 1 further including holding means, coupled to said rollers and, for each of said rollers, switchable between first and second configurations, for, in the second of said configurations, increasing the exterior perimeter of said roller over that of said roller with said roller in said first configuration.

19. The improvement of claim 18 wherein said control means operates under pneumatic power and control.

20. In a device for spooling an elongated web of material including:

(A) a frame;

(B) a plate movably coupled to said frame;

(C) a plurality of take-up rollers rotatably mounted on said plate;

(D) motive means, coupled to said plate and said frame, for moving said plate in a manner to sequentially and repeatedly bring each of said rollers in turn to a particular location and subsequently away from said particular location: and (E) revolving means, coupled to the one of said rollers in said particular location, for rotating said one roller, the improvement comprising (1) braking means, coupled to said one of said rollers for, after said revolving means has rotated said one roller and before said one roller has returned to said particular location, stopping the rotation of said one roller, (2) cutting means, coupled to said frame, for severing said web, and (3) restraining means, coupled to said frame, for, when said cutting means severs said web, resisting the movement of the portion of said web immediately past where said cutting means severs said web in a direction opposite to the direction said web moves when spooling onto said take-up roller in said particular location, said restraining means including a roller in contact with said portion of said web, said web moving freely in the direction said web moves when spooling onto said particular roller but having substantial resistance to moving in the opposite direction.

21. The improvement of claim 20 further including pneumatic knife control means, coupled to said cutting means, for powering and controlling the action of said cutting means.

22. The improvement of claim 21 further including pneumatic brake control means, coupled to said brake means, for powering and controlling the action of said brake means.

23. The improvement of claim 22 further including clutch means, coupled between said revolving means and said roller at said particular location, for applying to said roller at said particular location a substantially constant force from said revolving means regardless of the amount of said web spooled on said roller at said location.

24. The improvement of claim 20 wherein said clutch means includes a magnetic clutch.

25. The improvement of claim 20 further including dampening means, coupled to said cutting means, for reducing the speed of said cutting means as it moves from said first to said second position and prior to the time said cutting means reaches said second position.

26. The improvement of claim 23 wherein said dampening means includes a spring connected to said cutting means, said cutting means, as it moves from said first to said second position, increasing the force exerted by said spring in the direction opposite to that in which said cutting means travels when moving from said first to said second position.

27. The improvement of claim 26 wherein said braking means includes a frictional surface facing said one of said rollers and said brake control means urges said surface against said one roller.

28. The improvement of claim 27 wherein said control means urges said surface against said one roller at said particular location.

29. The improvement of claim 20 further including holding means, coupled to said rollers and, for each of said rollers, switchable between first and second configurations, for, in the second of said configurations, increasing the exterior perimeter of said roller over that of said roller with said roller in said first configuration.

30. In a device for spooling an elongated web of material including:

(A) a frame;

(B) a plate movably coupled to said frame;

(C) a plurality of take-up rollers rotatably mounted on said plate;

(D) motive means, coupled to said plate and said frame, for moving said plate in a manner to sequentially bring each of said rollers in turn to a particular location; and (E) revolving means, coupled to the one of said rollers in said particular location, for rotating said one roller, the improvement comprising (1) clutch means, coupled between said revolving means and said roller at said particular location, for applying to said roller at said particular location a substantially constant force from said revolving means regardless of the amount of said web spooled on said roller at said location, (2) cutting means, coupled to said frame, for severing said web, and (3) restraining means, coupled to said frame, for when said cutting means severs said web, resisting the movement of the portion of said web immediately past where said cutting means severs said web in a direction opposite to the direction said web moves when spooling onto said take-up roller in said particular location said restraining means including a roller in contact with said portion of said web, said web moving freely in the direction said web moves when spooling onto said particular roller but having substantial resistance to moving in the opposite direction.

31. The improvement of claim 30 further including pneumatic knife control means, coupled to said cutting means, for powering and controlling the action of said cutting means.

32. The improvement of claim 31 wherein said clutch means includes a magnetic clutch.

33. The improvement of claim 31 further including dampening means, coupled to said cutting means, for reducing the speed of said cutting means as it moves from said first to said second position and prior to the time said cutting means reaches said second position.

34. The improvement of claim 33 wherein said dampening means includes a spring connected to said cutting means, said cutting means, as it moves from said first to said second position, increasing the force exerted by said spring in the direction opposite to that in which said cutting means travels when moving from said first to said second position.

35. The improvement of claim 33 further including holding means, coupled to said rollers and, for each of said rollers, switchable between first and second configurations, for, in the second said configurations, increasing the exterior perimeter of said roller over that of said roller with said roller in said first configuration.

36. In a device for spooling an elongated web of material including:

(A) a frame;

(B) a plate movably coupled to said frame;

(C) a plurality of take-up rollers rotatably mounted on said plate;

(D) motive means, coupled to said plate and said frame, for moving said plate in a manner to sequentially bring each of said rollers in turn to a particular location;

(E) revolving means, coupled to the one of said rollers in said particular location, for rotating said one roller; and (E) cutting means, coupled to said frame and mounted between first and second positions, for, when moving from said first position to said second position, severing an elongated web of material being spooled onto a core affixed to said one of said rollers in said particular location, the improvement comprising (1) dampening means, coupled to said cutting means, for reducing the speed of said cutting means as it moves from said first to said second position and prior to the time said cutting means reaches said second position and (2) restraining means, coupled to said frame, for, when said cutting means severs said web, resisting the movement of the portion of said web immediately past where said cutting means severs said web in a direction opposite to the direction said web moves when spooling onto said take-up roller in said particular location, said restraining means including a roller in contact with said portion of said web, said web moving freely in the direction said web moves when spooling onto said particular roller but having substantial resistance to moving in the opposite direction.

37. The improvement of claim 36 further including pneumatic knife control means, coupled to said cutting means, for powering and controlling the action of said cutting means.

38. The improvement of claim 37 wherein said dampening means includes a spring connected to said cutting means, said cutting means, as it moves from said first to said second position, increasing the force exerted by said spring in the direction opposite to that in which said cutting means travels when moving from said first to said second position.

39. The improvement of claim 36 further including holding means, coupled to said rollers and, for each of said rollers, switchable between first and second configurations, for, in the second of said configurations, increasing the exterior perimeter of said roller over that of said roller with said roller in said first configuration.

40. In a device for spooling an elongated web of material including:

(A) a frame;

(B) a plate movably coupled to said frame;

(C) a plurality of take-up rollers rotatably mounted on said plate;

(D) motive means, coupled to said plate and said frame, for moving said plate in a manner to sequentially bring each of said rollers in turn to a particular location;

(E) revolving means, coupled to the one of said rollers in said particular location, for rotating said one roller;

(E) cutting means, coupled to said frame, for severing an elongated web of material being spooled onto a core affixed to said one of said take-up rollers at said particular location, the improvement comprising restraining means, coupled to said frame, for, when said cutting means severs said web, resisting the movement of the portion of said web immediately past where said cutting means severs said web in a direction opposite to the direction said web moves when spooling onto said take-up roller in said particular location said restraining means including a roller in contact with said portion of said web, said web moving freely in the direction said web moves when spooling onto said particular roller but having substantial resistance to moving in the opposite direction.

41. The improvement of claim 40 further including holding means, coupled to said rollers and, for each of said rollers, switchable between first and second configurations, for, in the second of said configurations, increasing the exterior perimeter of said roller over that of said roller with said roller in said first configuration.

42. In a device for spooling an elongated web of material including:

(1) a frame;

(2) a plate movably coupled to said frame;

(3) a plurality of take-up rollers mounted on said plate;

(4) motive means, coupled to said plate and said frame, for moving said plate in a manner to sequentially bring each of said rollers in turn to a particular location;

(5) revolving means, coupled to the one of said rollers in said particular location, for rotating said one roller, the improvement comprising:

(A) pneumatic control means, coupled to said motive means, for, operating under pneumatic power and control, (1) with one of said rollers in said particular location, causing said motive means to move said plate to bring another of said rollers to said particular location and (2) stopping said motive means from moving said plate when said another of said rollers reaches said particular location:

(B) cutting means, coupled to said frame, for severing said web;

(C) knife control means, coupled to said cutting means, for powering and controlling the action of said cutting means; and (D) restraining means, coupled to said frame, for, when said cutting means severs said web, resisting the movement of the portion of said web immediately past where said cutting means severs said web in a direction opposite to the direction said web moves when spooling onto said take-up roller in said particular location, said restraining means including a roller in contact with said portion of said web, said roller moving freely in the direction said web moves when spooling onto said particular roller but having substantial resistance to moving in the opposite direction.

43. In a device for spooling an elongated web of material including:

(1) a frame;

(2) a plate movably coupled to said frame;

(3) a plurality of take-up rollers mounted on said plate;

(4) motive means, coupled to said plate and said frame, for moving said plate in a manner to sequentially bring each of said rollers in turn to a particular location; and (5) revolving means, coupled to the one of said rollers in said particular location, for rotating said one roller, the improvement comprising:

(A) control means, coupled to said motive means, for (1) with one of said rollers in said particular location, causing said motive means to move said plate to bring another of said rollers to said particular location and (2) stopping said motive means from moving said plate when said another of said rollers reaches said particular location:

(B) cutting means, coupled to said frame, for severing said web;

(C) knife control means, coupled to said cutting means, for powering and controlling the action of said cutting means; and (D) restraining means, coupled to said frame, for, when said cutting means severs said web, resisting the movement of the portion of said web immediately past where said cutting means severs said web in a direction opposite to the direction said web moves when spooling onto said take-up roller in said particular location, said restraining means including a roller in contact with said portion of said web, said roller moving freely in the direction said web moves when spooling onto said particular roller but having substantial resistance to moving in the opposite direction.

* * * * *